US009004229B2

(12) United States Patent
Lindberg et al.

(10) Patent No.: US 9,004,229 B2
(45) Date of Patent: Apr. 14, 2015

(54) MARKING DEVICE IN ELEVATOR SYSTEM

(75) Inventors: Bjarne Lindberg, Adligenswil (CH); Astrid Sonnenmoser, Ebikon (CH)

(73) Assignee: Inventio AG, Hergiswil (CH)

( * ) Notice: Subject to any disclaimer, the term of this patent is extended or adjusted under 35 U.S.C. 154(b) by 835 days.

(21) Appl. No.: 13/266,961

(22) PCT Filed: Mar. 1, 2010

(86) PCT No.: PCT/EP2010/052545

§ 371 (c)(1),
(2), (4) Date: Feb. 2, 2012

(87) PCT Pub. No.: WO2010/124891

PCT Pub. Date: Nov. 4, 2010

(65) Prior Publication Data

US 2012/0118219 A1 May 17, 2012

(30) Foreign Application Priority Data

Apr. 29, 2009 (EP) ..... 09159061

(51) Int. Cl.

| | |
|---|---|
| ***B66B 1/34*** | (2006.01) |
| ***B66B 19/00*** | (2006.01) |
| ***B66B 13/12*** | (2006.01) |

(52) U.S. Cl.

CPC ..... *B66B 19/00* (2013.01); *B66B 13/12* (2013.01)

(58) Field of Classification Search

USPC ..... 187/247, 313–316, 325, 333, 391, 393, 187/406; 116/201, 226

See application file for complete search history.

(56) References Cited

U.S. PATENT DOCUMENTS

| | | | | |
|---|---|---|---|---|
| 6,070,700 | A * | 6/2000 | Nagel | 187/335 |
| 6,540,048 | B1 * | 4/2003 | Muller | 187/325 |
| 6,945,363 | B2 * | 9/2005 | Angst et al. | 187/317 |
| 8,672,098 | B2 * | 3/2014 | Kashiwakura et al. | 187/316 |
| 2007/0017750 | A1 * | 1/2007 | Mustalahti et al. | 187/254 |
| 2009/0266651 | A1 * | 10/2009 | Van Der Meijden et al. | 187/408 |
| 2014/0138189 | A1 * | 5/2014 | van der Meijden et al. | 187/406 |

FOREIGN PATENT DOCUMENTS

| | | | |
|---|---|---|---|
| EP | 0679602 | A1 | 11/1995 |
| EP | 1295839 | A1 | 3/2003 |
| JP | 58176506 | A | 10/1983 |
| JP | 05229764 | A | 9/1993 |

* cited by examiner

*Primary Examiner* — Anthony Salata

(74) *Attorney, Agent, or Firm* — Fraser Clemens Martin & Miller LLC; William J. Clemens

(57) ABSTRACT

In order to achieve simple maintenance and/or installation of an elevator system, a marking device has at least one light emitting unit for generating at least one mark on a component of the system.

19 Claims, 15 Drawing Sheets

MARKING DEVICE IN ELEVATOR SYSTEM

FIELD OF THE INVENTION

The invention relates to a marking device in an elevator installation, which is termed marking device in the following.

BACKGROUND OF THE INVENTION

An object of the invention consists particularly in providing a device which simplifies mounting and/or maintenance of an elevator component. In particular, this device shall facilitate the alignment and/or locating or recognition of components of an elevator installation.

SUMMARY OF THE INVENTION

A marking device is proposed which comprises at least one light emission unit, which emits a light beam which is provided for generating at least one marking on an object present in the elevator installation. By "marking" there is to be understood, in particular, a light mark which is visible preferably by reflection of the light beam on the said object, wherein the object can preferably be an elevator component or an auxiliary device.

On the one hand the marking—i.e. the light mark—can mark a reference position, which, for example, serves for positioning at least one elevator component, which is to be adjusted after coarse mounting has been carried out or the position of which is to be checked at the time of maintenance of the elevator installation. The marking then has the function of a positioning marking. By "reference position" there is to be understood, in particular, a position starting from which a target position of at least one elevator component is advantageously determinable. By "positioning" of an elevator component there is to be understood, in particular, an arrangement of the elevator components in a defined position or an orientation of the elevator component in a defined position relative to at least one other elevator component, i.e. to a reference element.

On the other hand, the marking can serve for characterization of at least one elevator component which is to be adjusted and/or to be checked and/or to be maintained and/or to be mounted. This means that in the case of mounting and particularly in the case of maintenance of the elevator installation markings which characterize elevator components to be maintained or to be adjusted or refer to these can be produced within the elevator installation by means of at least one light beam settable in its direction. Mounting or maintenance sequences can thereby be organized so that these are faultlessly performable even by less experienced personnel.

A simple maintenance and/or mounting of an elevator component can be achieved by an embodiment of the marking device in accordance with the invention. In particular, an elevator component of a shaft door can be arranged precisely relative to a reference element of an elevator car, whereby, in particular, a low output of noise, for example during opening of elevator doors, is achievable. In particular, a convenient capability of maintenance and, especially, a working position convenient for an engineer can be achieved, for example because a substantial spacing can be present between an elevator component which is to be adjusted and a reference element. Moreover, maintenance errors can be avoided and maintenance efficiency increased in that the elevator component to be maintained or checked is shown by a settable light beam. A particularly high maintenance or mounting efficiency can be achieved if the light emission unit marks two or more elevator components, which are to be maintained and/or mounted, successively in time with a light beam in correspondence with a maintenance or mounting program.

The markings are preferably present as temporary positioning markings or as characterizations which do not exist in a switched-off state of the marking device according to the invention.

At least one elevator device is provided for the fixing and positioning of the marking device in the elevator installation. By "elevator device" there is to be understood, in particular, a part of a complete elevator installation at which a marking device is fastened or which is provided and designed for the fastening of a marking device. Such an elevator device can comprise a fastening unit, by which the marking device is fixed to the elevator device. An elevator device can be present in the form of an elevator shaft device or in the form of an elevator car device. By "elevator shaft device" there is to be understood in that case, in particular, an elevator device which is part of an elevator shaft and/or is arranged at or fixed to an elevator shaft. By "elevator car device" there is to be understood in that case, in particular, an elevator device which is formed by an elevator car or is part of an elevator car or is mounted on an elevator car. An elevator device or a fastening unit present at the elevator device can comprise a positioning device which facilitates positioning or adjusting of the marking device at the elevator device. A "positioning device" can include, for example, mechanical abutments, at least one pivot device, at least one clamping device, color markings, scales, etc. An elevator device can comprise a housing which forms at least one receiving region in which the marking device is arranged at least in part. A protected and secure arrangement of the marking device can thereby be achieved.

In the case of fixing of the marking device to an elevator car device this elevator car device is preferably formed by a car door lintel of the car door. This is particularly advantageous in the case of maintenance and/or mounting, in which elevator components—particularly coupling means—provided for coupling of a shaft door leaf with a car door leaf are positioned at shaft doors. By "coupling" between a shaft door leaf and a car door leaf there is to be understood, in particular, a mechanical connection between a shaft door leaf and the car door leaf, which transmits an opening or closing movement of the car door leaf to a respectively corresponding shaft door leaf when the elevator car is opposite a shaft door.

The light emission unit preferably comprises at least one laser for generating the elevator beam. A precise marking and an accurate positioning of the elevator components to be positioned can thereby be achieved. Moreover, through the use of a laser it is possible to characterize elevator components spaced far from the light emission unit.

With advantage, the marking device comprises at least one beam shaping means, which is preferably exchangeable and which so influences the light beam that a particularly advantageous optical marking can be achieved. A particularly informative optical marking can be achieved if the marking device comprises at least one optical lens and/or a lens prism as beam shaping means. The light beam can thus, for example, be spread out in such a manner in one plane or two planes that a straight line or two straight lines at right angles to one another can be marked by the spread-out light beam on the object to be marked.

In a preferred form of embodiment of the invention the marking device comprises at least one fastening means which is formed as a magnet. A simple fastening of the marking device, for example to a reference element of the elevator installation, can thus be achieved.

With advantage, the marking device comprises at least one battery and/or accumulator, whereby a simple power supply for a marking device, which is freely displaceable in the elevator installation, can be achieved.

If the marking device has a mains current connection, a reliable energy supply, for example recharging of the accumulator, can be achieved.

A precise positioning of the light emission unit can be achieved if the marking device comprises at least one adjusting means. The adjusting means is preferably formed as a screw, whereby a stepless adjustability is achievable.

Moreover, it is proposed that the marking device comprises at least one positioning unit with at least one bend for positioning of the marking device. An accurate positioning of the marking device can be achieved by such a positioning unit.

With advantage, the marking device comprises at least two light sources, whereby a more flexible capability of use is achievable. In particular, a convenient capability of maintenance can be achieved. In particular, several objects present in the elevator installation can be marked at the same time.

With advantage, the marking device comprises at least one mounting unit which movably mounts the light emission unit. In that case, by the term "movably mounted" there is to be understood, in particular, that the light emission unit in a mounted state is formed to be movable relative to at least one component of the marking device. A flexible capability of use of the marking device can thereby be achieved. A constructionally simple build can be achieved if the mounting unit rotatably mounts the light emission unit.

Moreover, a marking method is proposed in which a marking device and an elevator device come into use in accordance with the foregoing description and in which at least one elevator component or the intended mounting point of at least one elevator component is marked by at least one light beam. A simple maintenance and/or mounting of an elevator component can be achieved by such a method. In particular, a component of a shaft door can be arranged precisely relative to an element of an elevator car device, whereby, in particular, a low output of noise, particularly at the time of opening closing of elevator doors, is achievable.

Advantageously, in the marking method at least one target position of at least one elevator component is marked. A simple and accurate positioning of the elevator component can thereby be achieved at the time of installation or maintenance of the elevator installation.

According to a further embodiment of the marking method at least one already-installed elevator component, which is to be adjusted and/or checked and/or maintained, and/or the mounting point of at least one elevator component to be mounted is or are marked in the sense of a characterization. In this manner, for example, elevator components to be maintained in accordance with a work plan or the mounting points of elevator components to be installed can be characterized in succession. It can thus be ensured that every planned procedure is executed, wherein on each occasion the correct elevator component is adjusted or each elevator component to be installed is installed at the intended mounting point. In addition, it is possible to achieve, in particular, a smaller outlay in terms of time for the installation or maintenance of the elevator installation.

Moreover, a marking method is proposed in which at least one elevator component which is a part of a shaft door is marked by a positioning marking and in which an engineer in an elevator car positions this elevator component via an opened car door with the help of the positioning marking. A convenient positioning can thereby be achieved.

In addition, a marking method is proposed in which an elevator component which is part of a shaft door is marked by at least one positioning marking generated by at least one light beam and in which an engineer who is on a roof of an elevator car device positions the elevator component on the basis of the positioning marking. A simple capability of maintenance and/or capability of mounting can be achieved in this manner. In particular, a maintenance and/or a mounting of an elevator component which is part of an uppermost shaft door of an elevator installation can be performed in simple manner.

Moreover, it is proposed that before positioning of an elevator component the elevator car is moved into a position in which the car door of the elevator car is displaced in height with respect to the corresponding shaft door. A maintenance and/or mounting position convenient for the engineer can thereby be achieved. In particular, when the elevator component to be adjusted is a coupling means which is mounted on a shaft door and which is to be aligned relative to an entrainer device mounted on a car door it is possible to select a car position in which an engineer standing in the elevator car can adjust the coupling means via the opened car door at a comfortable working height. The adjustment in that case is carried out on the basis of a marking which is generated by a marking device preferably fastened to the car door lintel of the elevator car, wherein the elevator car is so positioned that the car door lies above the corresponding shaft door by, for example, approximately a meter.

DESCRIPTION OF THE DRAWINGS

Further advantages are evident from the following drawing description. Exemplifying embodiments of the invention are illustrated in the drawing. The drawing, description and claims contain numerous features in combination. The expert will advantageously also consider the features individually and combine them into feasible further combinations.

FIG. 1 shows a view, as seen from the interior of an elevator car, of

Figure 1:
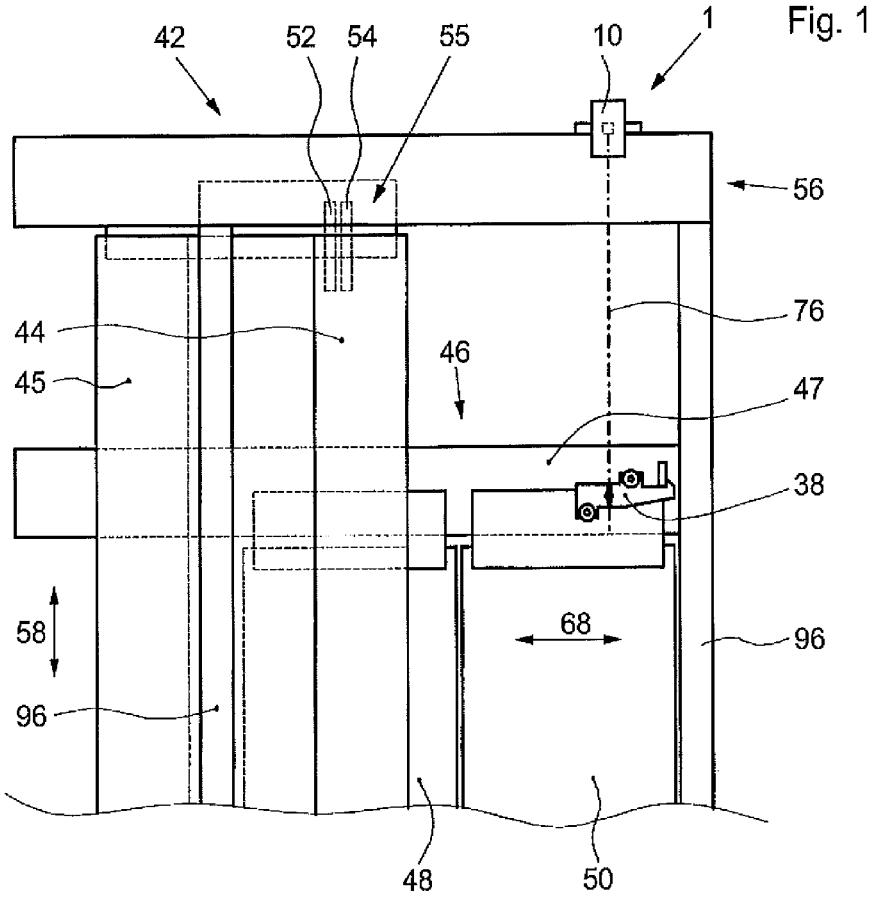
Figure 2:
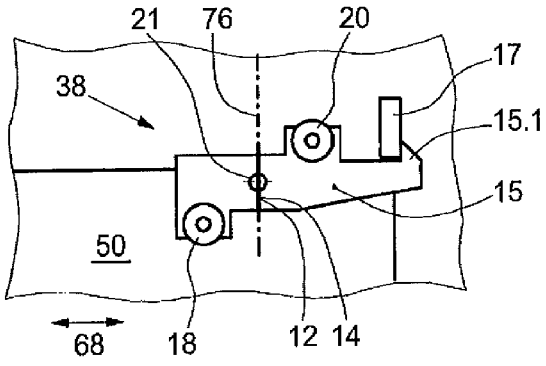
Figure 4:
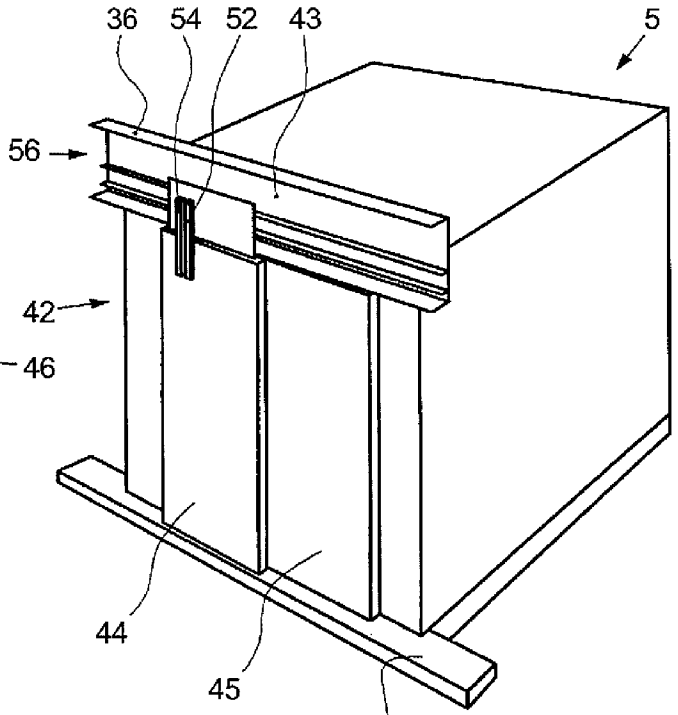
Figure 3:
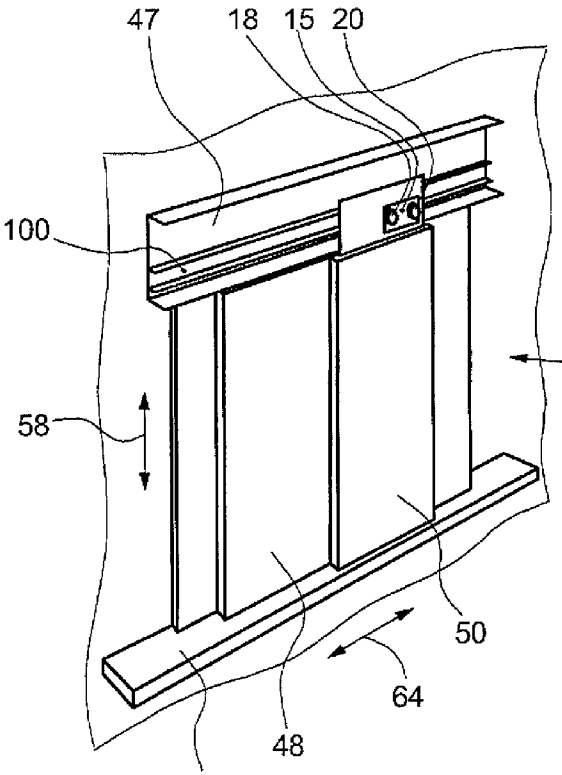
Figure 5:
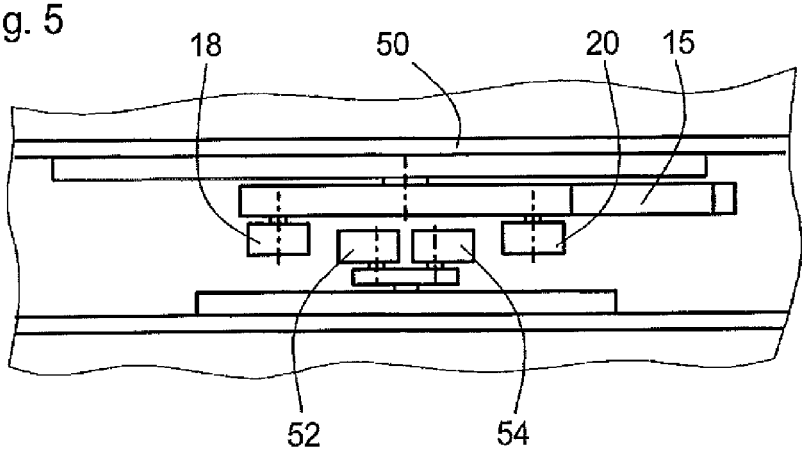
Figure 6:
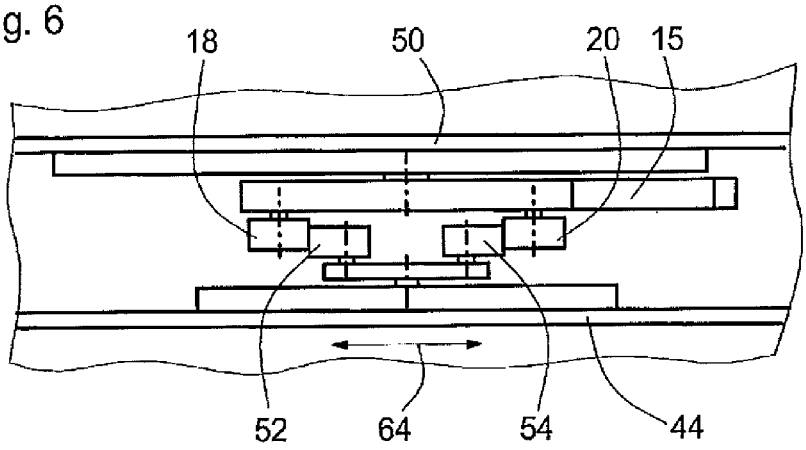
Figure 7:
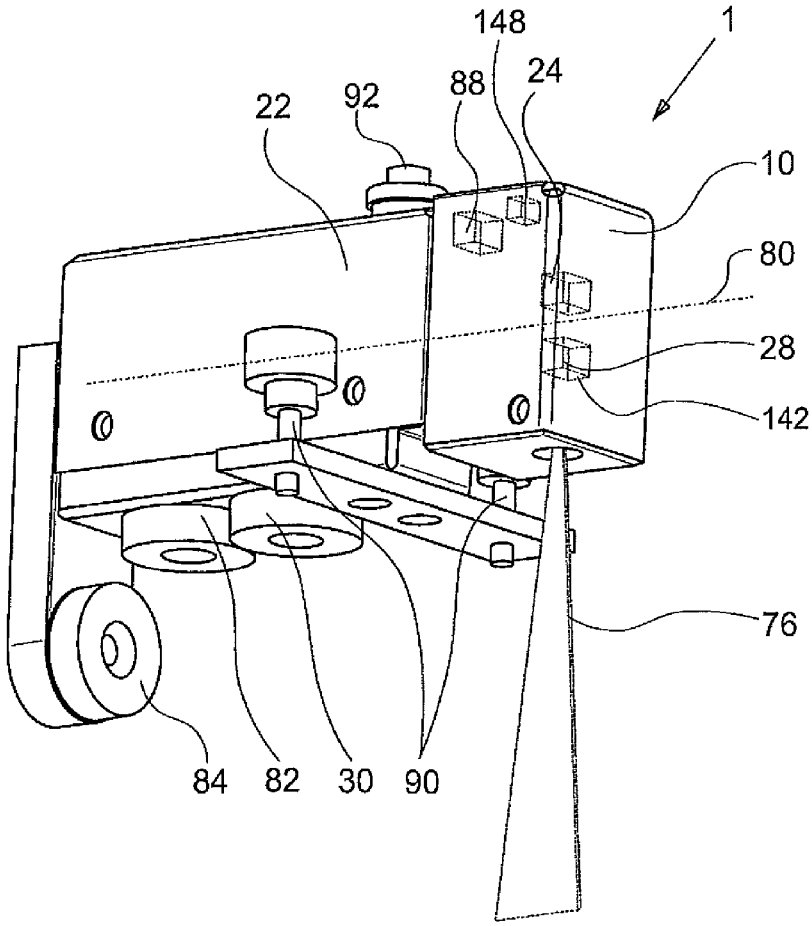
Figure 8:
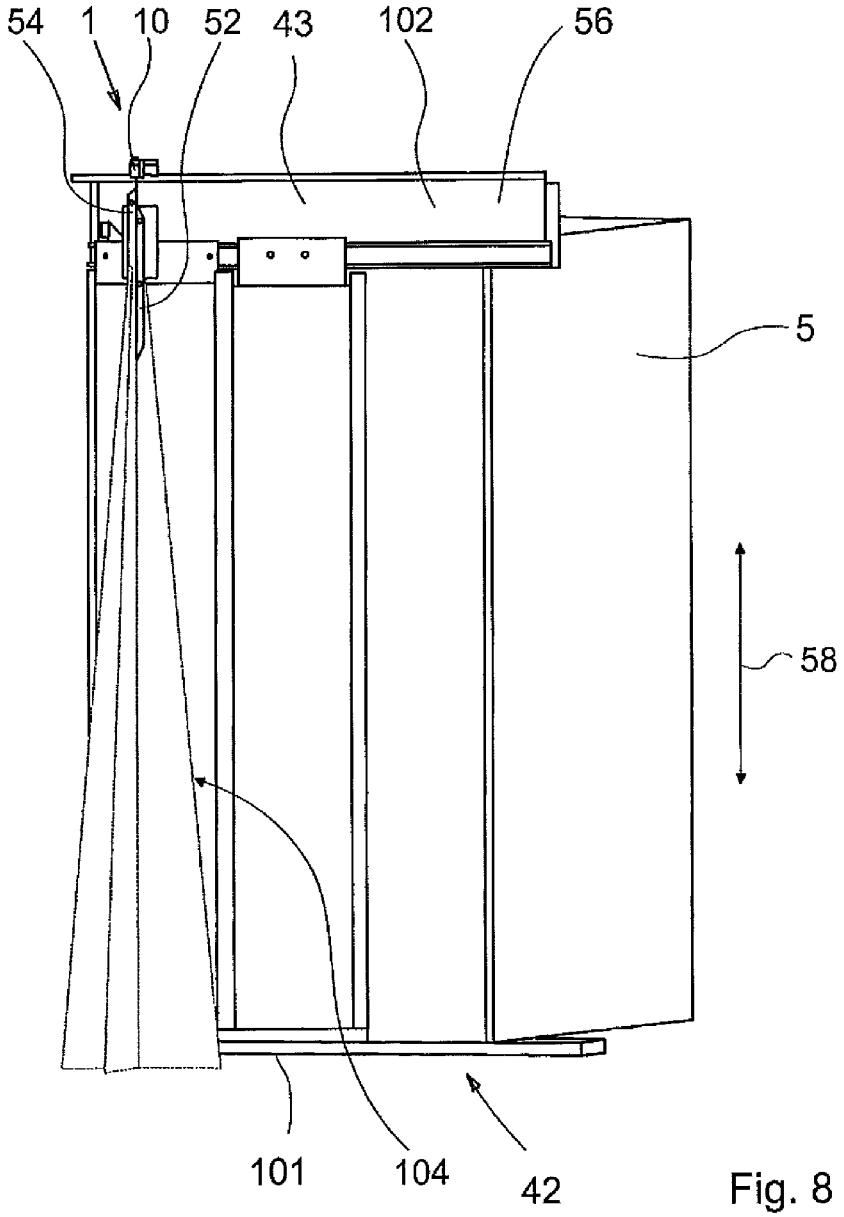
Figure 9:
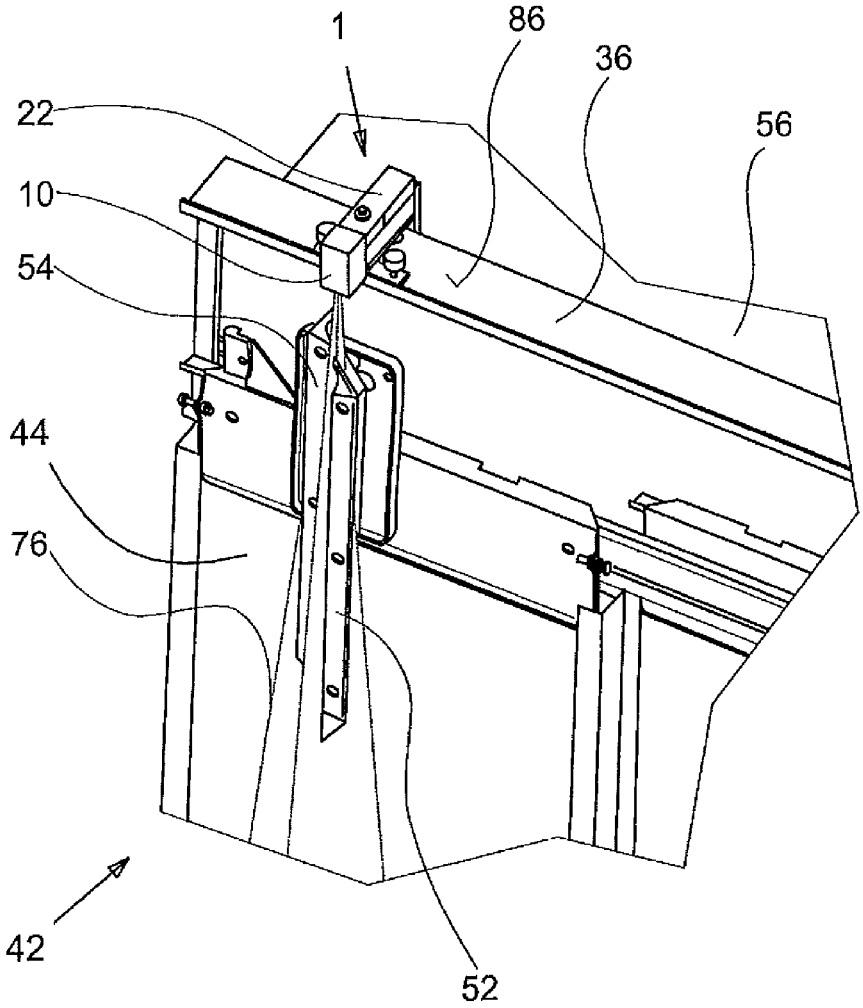
Figure 10:
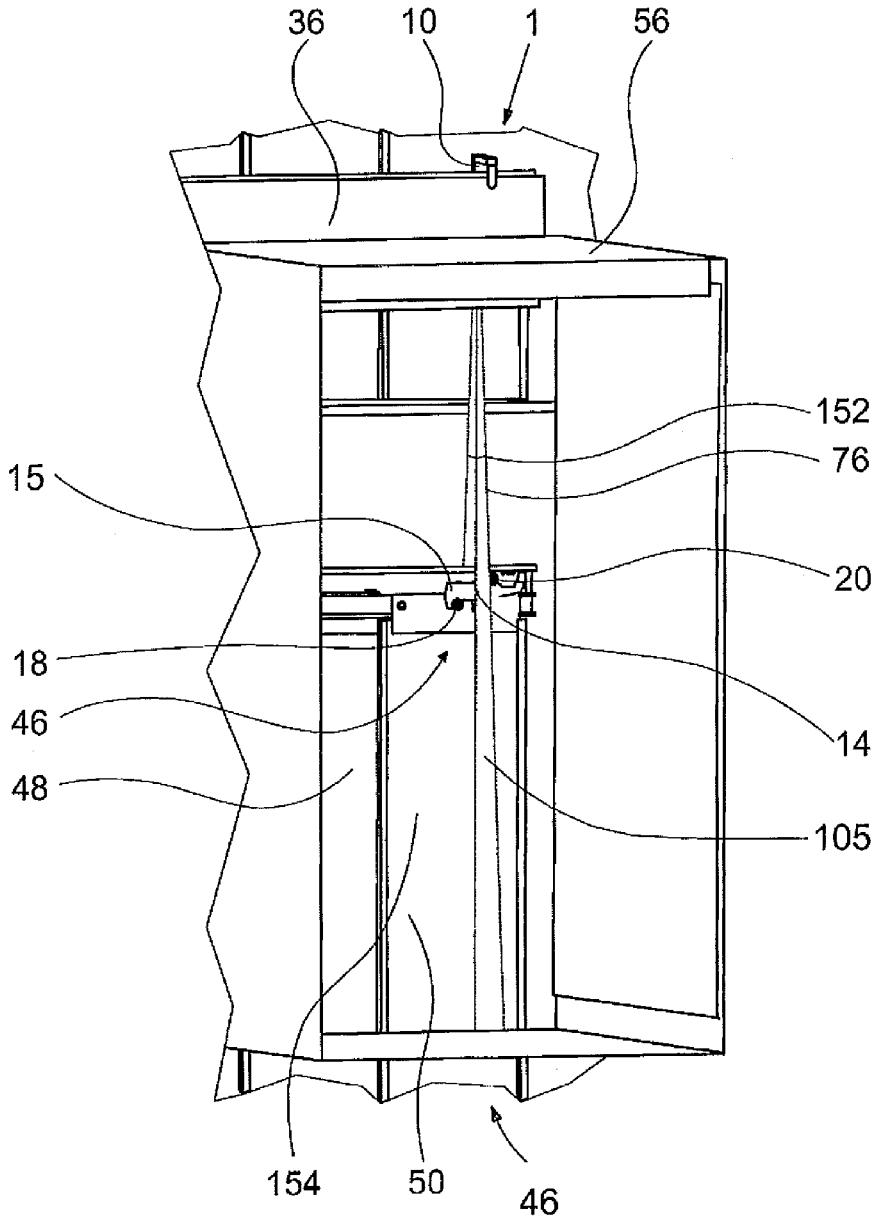
Figure 11:
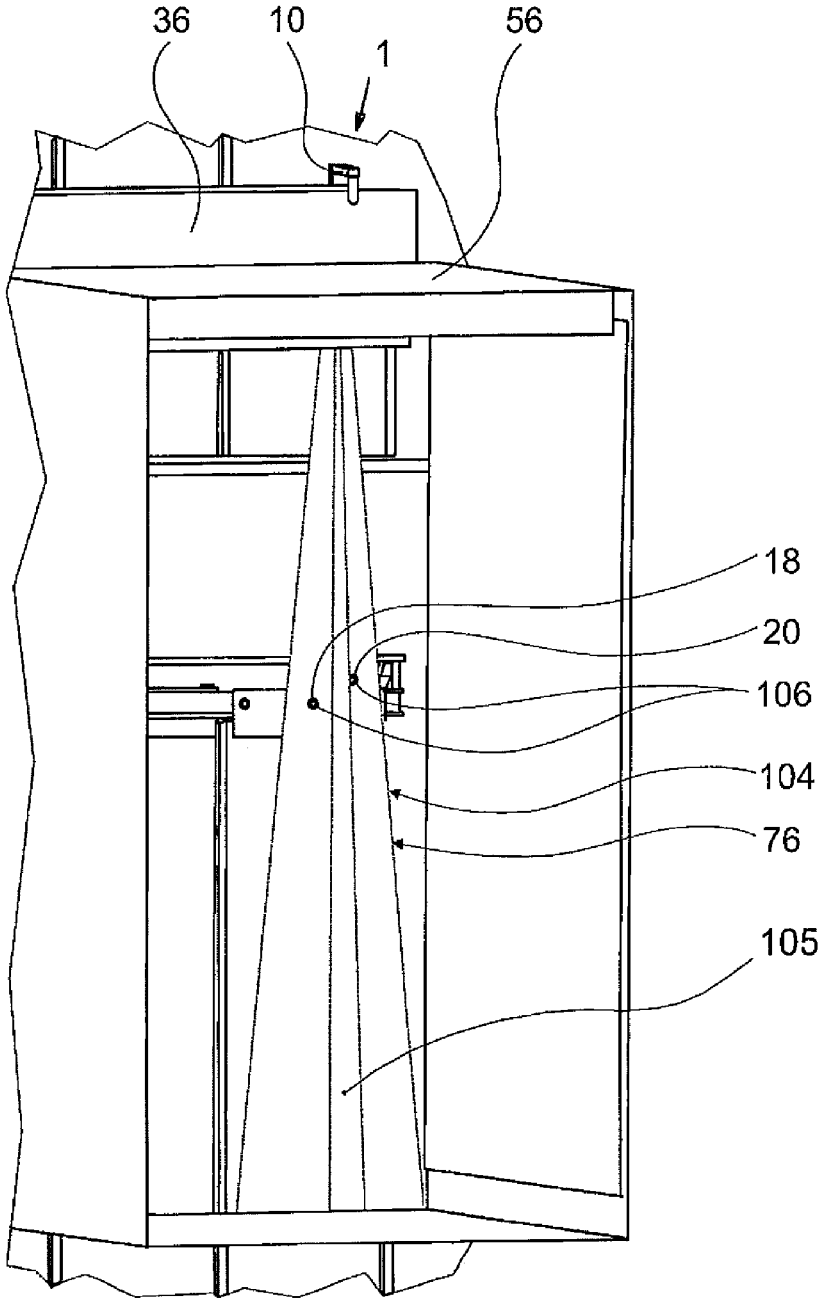
Figure 12:
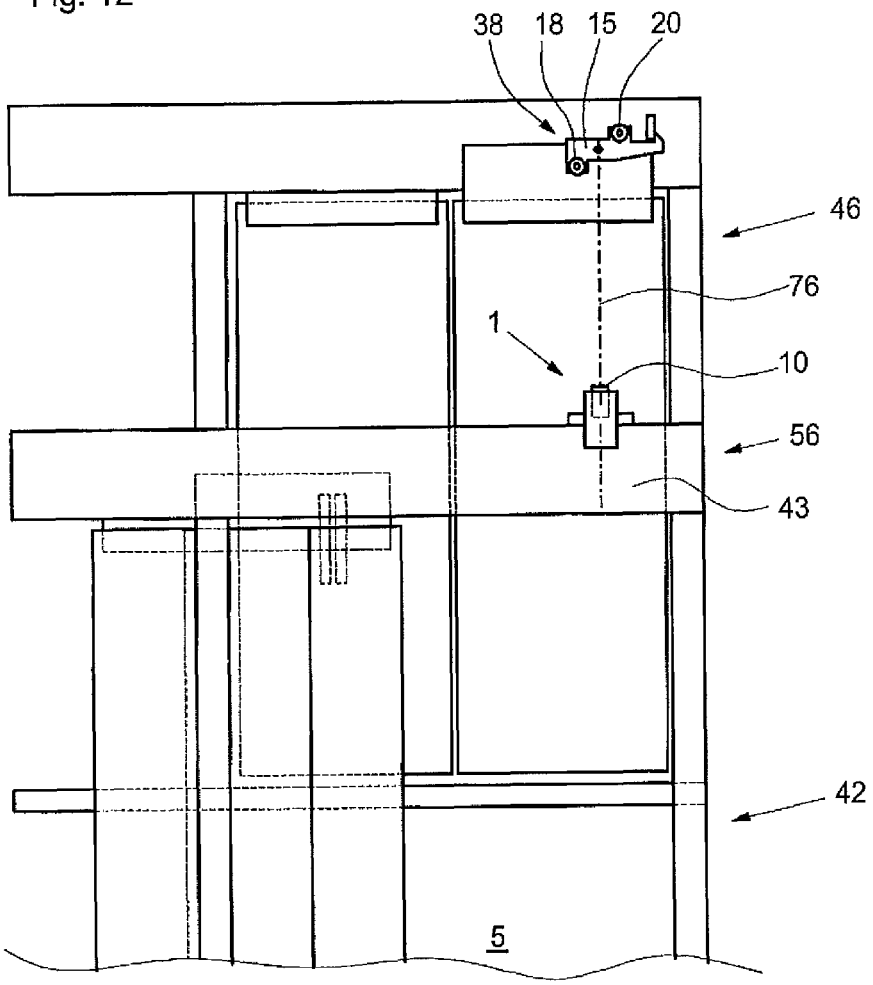
Figure 13:
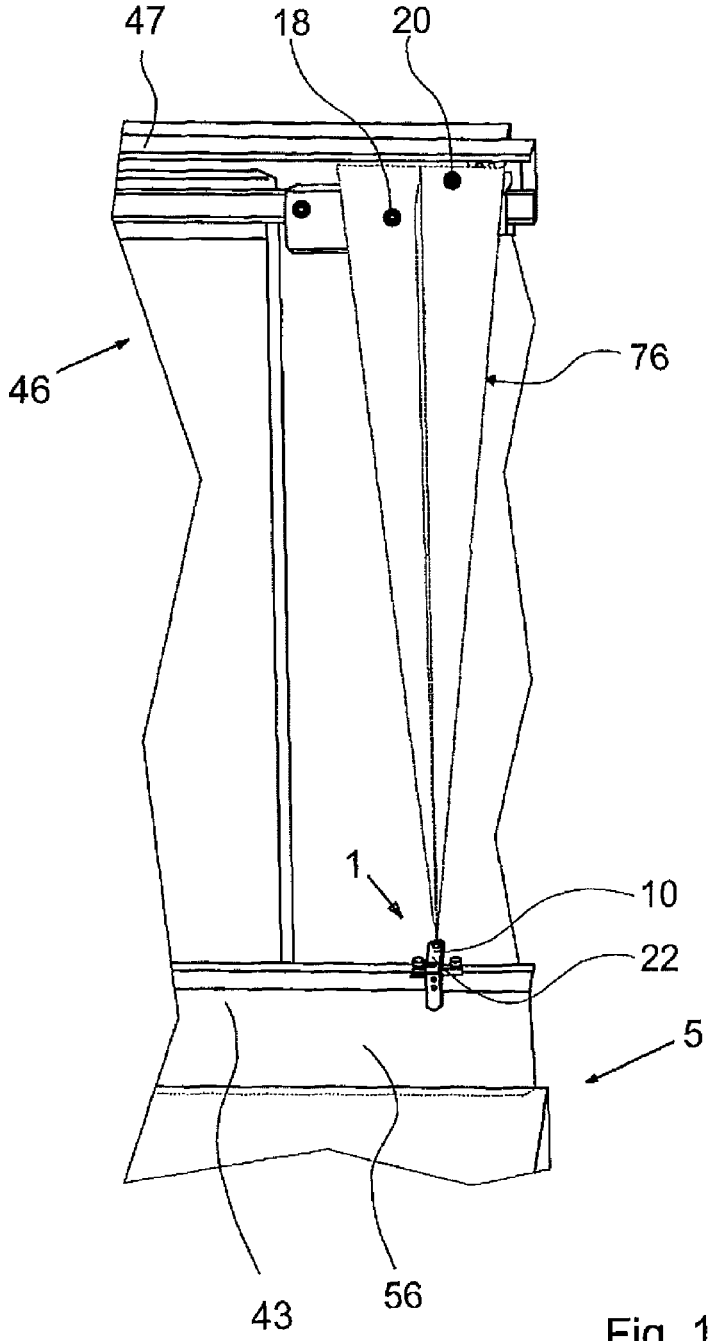
Figure 14:
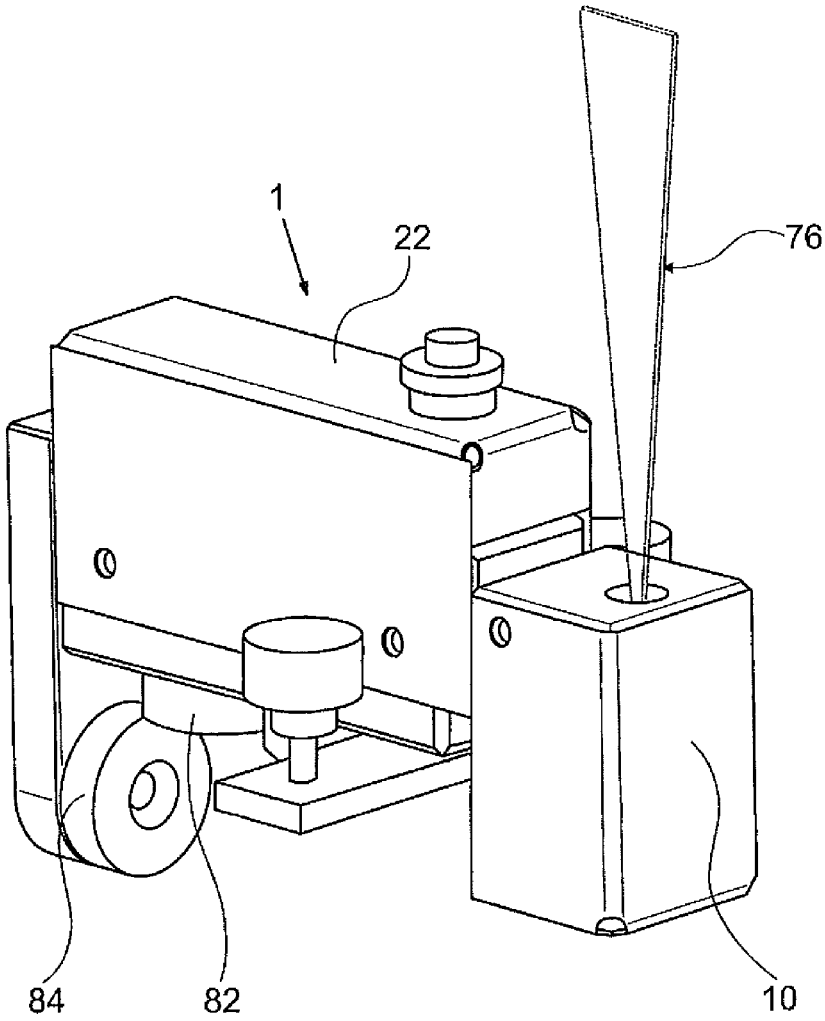
Figure 15:
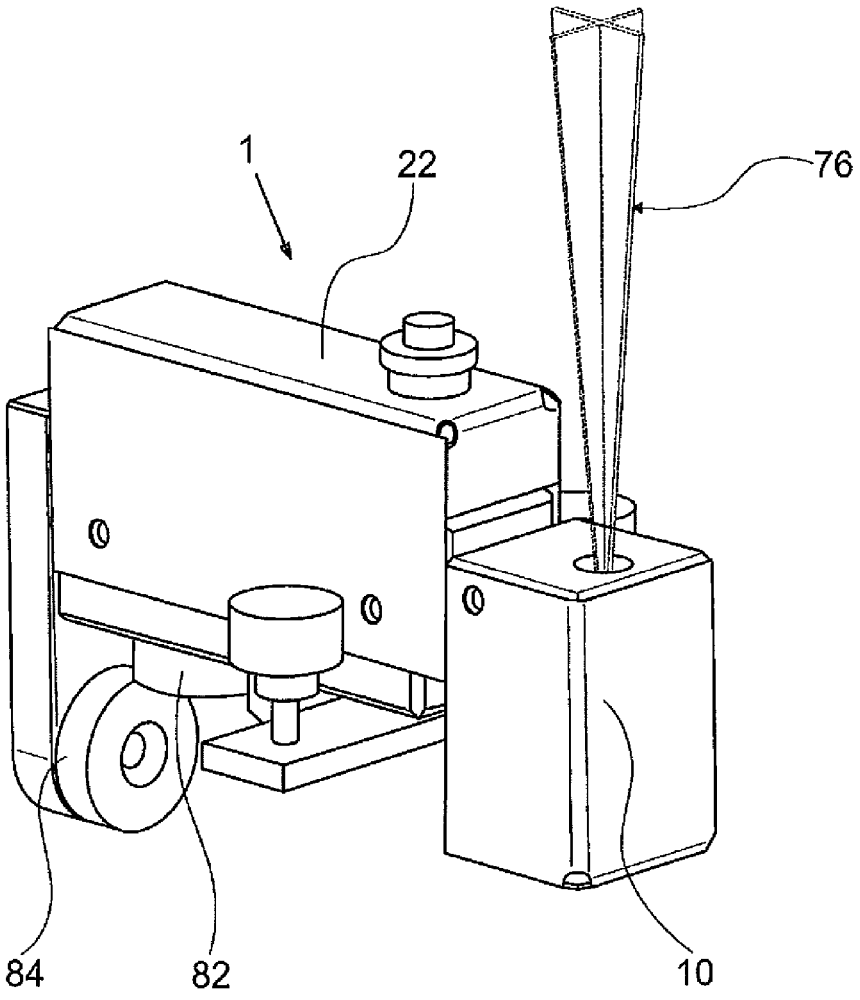
Figure 16:
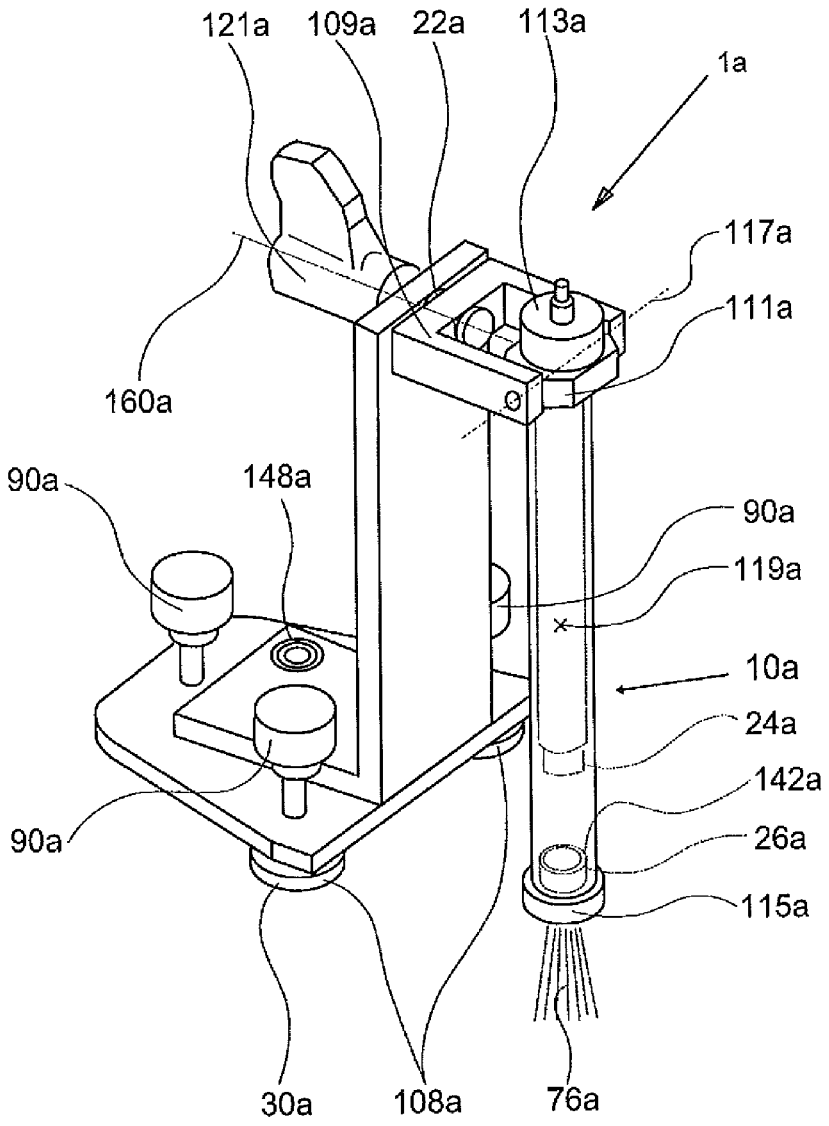
Figure 17:
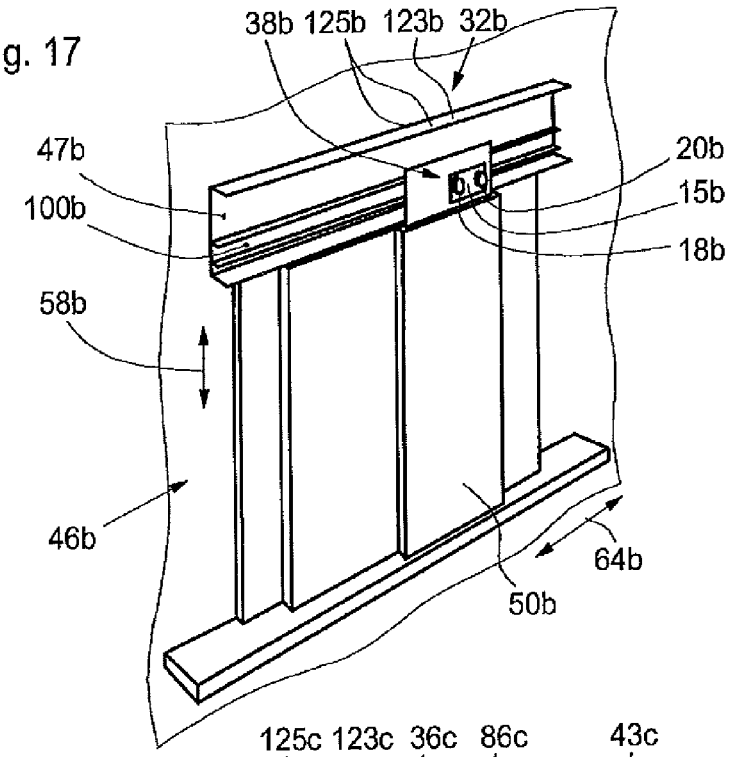
Figure 18:
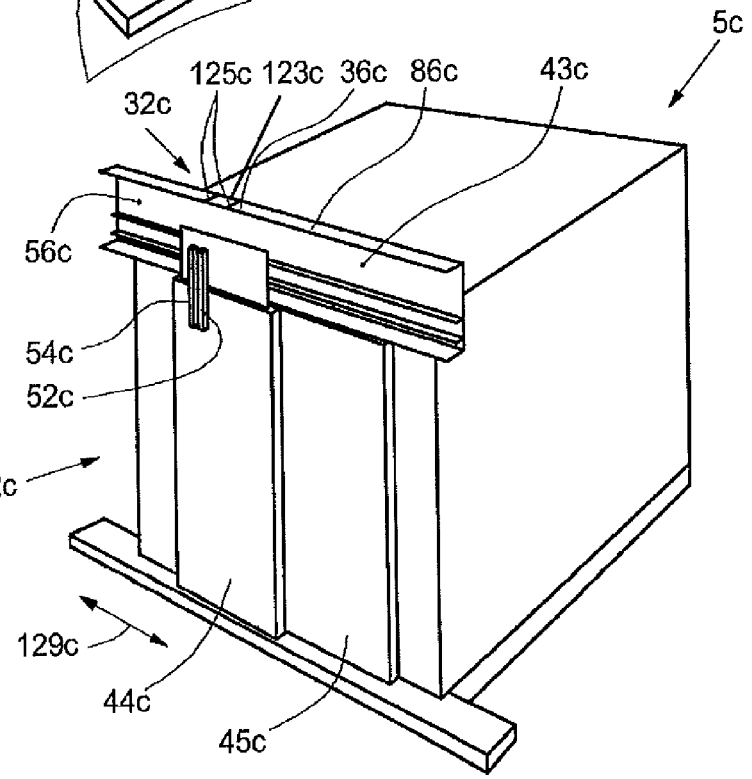
Figure 19:
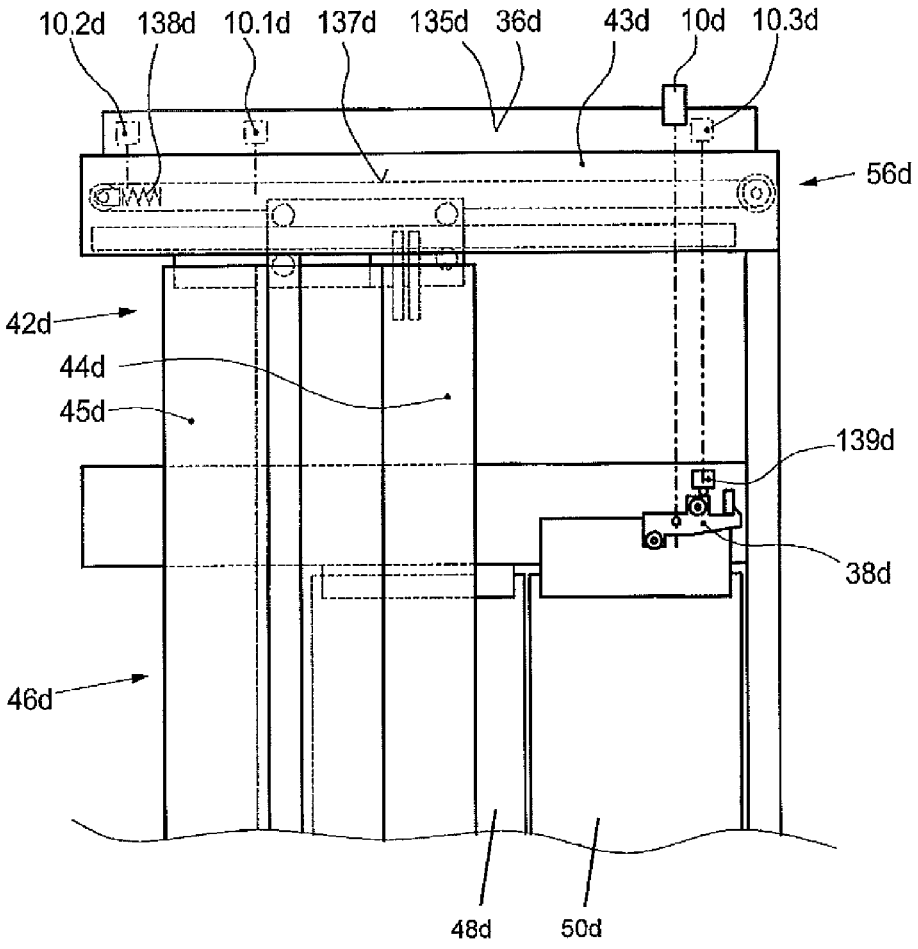

- a partly opened car door,
- an elevator car device, which is formed by the car door lintel of the elevator car, with a marking device fastened to the elevator car device,
- a shaft door, which is arranged behind the car door, with coupling means arranged at this, wherein the car door is so positioned that the shaft door is offset in height relative to the car door;

FIG. 2 shows a detail view of the coupling means according to FIG. 1;

FIG. 3 shows a schematic view of a shaft door;

FIG. 4 shows a schematic view of an elevator car device which is constructed as an elevator car and which serves as a carrier of the marking device;

FIG. 5 shows a plan view of a coupling device, which couples the car door with a shaft door, in uncoupled setting for travel past;

FIG. 6 shows a plan view of a coupling device, which couples the car door with a shaft door, in coupling setting;

FIG. 7 shows a view of the marking device;

FIG. 8 shows a view of the elevator car, which serves as an elevator car device, with the marking device in an operating state;

FIG. 9 shows a detail view of a part of the elevator car device and the marking device in the operating state according to FIG. 8;

FIG. 10 shows a view of the elevator car, which serves as an elevator car device, and the marking device fastened thereto, wherein the elevator car is positioned above the floor level with the corresponding shaft door and the marking device emits a downwardly directly light beam which forms a beam plane;

FIG. 11 shows a view as in FIG. 10, wherein the marking device emits a downwardly directly light beam which forms two intersecting beam planes;

FIG. 12 shows a view of a part of an elevator car device in a further operating state, in which the marking device emits a vertically upwardly directed light beam;

FIG. 13 shows a view of part of the elevator device in a further operating state, in which the elevator car is positioned below the floor level with the corresponding shaft door and the marking device emits an upwardly directed light beam which forms two intersecting beam planes;

FIG. 14 shows a view of the marking device in an operating state in which the marking device emits an upwardly directed light beam which forms one beam plane;

FIG. 15 shows a view of the marking device in an operating state in which the marking device emits an upwardly directed light beam which forms two intersecting beam planes;

FIG. 16 shows a view of an alternative exemplifying embodiment of a marking device;

FIG. 17 shows a view of an elevator shaft device formed by a shaft door;

FIG. 18 shows a view of an elevator car device formed by an elevator car; and FIG. 19 shows a view of an alternative exemplifying embodiment an elevator device with an alternative exemplifying embodiment of a marking device.

DETAILED DESCRIPTION OF THE INVENTION

FIG. 1 shows a view from the interior space of an elevator car (not illustrated here) onto a car door 42 with two partly opened car door leaves 44, 45 and onto a shaft door 46, which is arranged therebehind, with closed shaft door leaves 48, 50. Two skid-shaped coupling parts 52, 54 at the car door side are mounted on the car door leaf 44 and belong to an entrainer device 55. Also illustrated is an elevator car device 56 which belongs to the elevator car 5 (FIG. 4) and which is formed by the car door lintel 43 (FIG. 4) of the car door 42 and carries a marking device 1 according to the invention. The car door 42 additionally comprises two door posts 96 which together with the car door lintel 43 form part of a car door frame. The marking device 1 comprises a light emission unit 10 with a laser 24 (FIG. 7) which generates a vertically directed light beam 76. The marking device is in that case so positioned that the position of the light beam 76 in horizontal direction corresponds with the position in which the center of the entrainer device 55 is located when the car door leaf 44 adopts its closed setting. In the case of an intended operating process the marking device 1 generates a marking 12 (FIG. 2) in the form of a light mark on an object detected by the light beam. The marking 12 is formed as a positioning marking 14 and in the illustrated exemplifying embodiment serves for the positioning of a coupling means 38, which is at the shaft door side, with two shaft door rollers 18, 20 (FIG. 2) relative to the coupling parts 52, 54 at the car door side.

FIG. 2 shows the coupling means 38 at the car door side in enlarged illustration.

The coupling parts 52, 54 at the car door side are connected with the car door leaf 44 and both have substantially the form of a vertically oriented runner (FIGS. 1 and 4). During an opening or closing process of the car doors the coupling parts 52, 54 at the car door side move synchronously with the car door leaf 44. The coupling means 38, which is at the shaft door side, with the two shaft door rollers 18, 20 is mounted on a shaft door leaf 50 of the shaft door 46 and forms together with the coupling parts 52, 54 at the car door side a car door/shaft door coupling when the car door and a corresponding shaft door are opposite at the same level. For opening of the shaft door respectively opposite the elevator car the distance between the two coupling parts 52 and 54 at the car door side is increased so that these press against the shaft door rollers 18, 20 of the coupling means 38 at the shaft door side. On the one hand the coupling means 38 at the shaft door side is thereby rotated in clockwise sense, whereby a locking hook 15.1 connected with the coupling means 38 at the shaft door side is lowered and thus unlocks a shaft door lock. Such a shaft door lock is formed in that when the shaft door is closed the locking hook 15.1 connected with the coupling means 38 at the shaft door side latches with a locking stop 17 which is fixedly connected with the shaft door lintel 47 of the shaft door 46 (FIG. 2). On the other hand, the mentioned increase in the distance between the two coupling parts 52 and 54 at the car door side produces a play-free coupling, which provides a mechanically positive couple in horizontal direction, between these coupling parts and the shaft door rollers 18, 20 of the coupling means 38 at the shaft door side and thus between the car door leaf 44 and the shaft door leaf 50. A coupling part 15 at the shaft door side and the shaft door rollers 18, 20 together form the afore-mentioned coupling means 38 at the shaft door side, which is mounted on an axle 21 to be rotatable, but non-displaceable, on the shaft door leaf 50.

By way of the positioning marking 14, which makes a target position recognizable, an engineer who is in the elevator car can conveniently position the coupling means 38 at the shaft door side in that the engineer arranges the coupling means 38 at the shaft door side in a defined position relative to the reference position given by the position of the coupling parts 52 and 54 at the car door side. Before the arranging or positioning of the coupling means 38 at the shaft door side can be carried out the elevator car is moved into a position in which the car door 42 is arranged to be offset in vertical direction relative to the corresponding shaft door 46 (FIG. 1). It is thereby achieved that the coupling means 38 which is at the shaft door side and to be positioned is disposed during the positioning process at a working height convenient for the engineer standing in the elevator car.

If the elevator car with the car door 42 and with the elevator car device 56 moves during operation of the elevator in vertical direction 58 to the car position corresponding with the shaft door 46 then the coupling parts 52, 54 at the car door side move in between the shaft door rollers 18, 20 of the coupling means 38 at the shaft door side. If a stop of the elevator car device 56 at the floor to which the shaft door 46 belongs is intended, then the coupling parts 52, 54 at the car door side thus move, after they have moved in between the shaft door rollers 18, 20, from a travel-through position (FIG. 5), which they adopt during travel of the elevator car, in mutually opposite horizontal directions into a coupling position (FIG. 6) in which the coupling part 52 at the car door side bears against the shaft door roller 18 and the coupling part 54 at the car door side bears against the shaft door roller 20. In that case, as already mentioned above, the coupling means 38 at the shaft door side with the locking hook 15.1 rotates and thus unlocks the shaft door leaf 50 and couples the car door leaf 44 with the shaft door leaf 50.

The positioning marking 14 generated on the coupling means 38 at the shaft door side particularly during maintenance or mounting work is used for the purpose of so arranging and fastening the coupling means 38 at the shaft door side that the positioning marking 14 is arranged with respect to a horizontal direction 68 in the center between the two shaft door rollers 18, 20. If the two shaft door rollers 18, 20 have the same size spacing from the light beam 76 or from the positioning marking 14 generated by the light beam of the light emission unit 10 then the coupling means 38 at the shaft door side is located in its target position. The shaft door rollers 18 thereby reach and contact the coupling part 52 at the car door side, and the shaft door rollers 20 reach and contact the coupling part 54 at the car door side, at the same time during the movement of the coupling parts at the car door side from the travel-through position to the coupling position, whereby a high output of noise, particularly during this movement and particularly during a movement of the shaft door leaves 48, 50 with the help of the elevator components 52, 54, is avoided.

The coupling parts 52, 54 at the car door side are movably connected with the car door leaf 44 of the car door 42. In the coupling position (FIG. 6) these coupling parts 52, 54 at the car door side are immovable relative to one another with respect to a width direction 64 of the shaft door 46, which is equally a width direction of the car door 42 of the elevator car 5. In the coupling position (FIG. 6) the shaft door rollers 18, 20 are mechanically positively coupled with the coupling parts 52, 54 at the car door side with respect to a width direction 64 of the shaft door 46, i.e. in the direction of the opening or closing movement of the door leaf. Movements of the car door leaf 44 of the car door 42 (FIG. 4) of the elevator car 5 in the direction of the width direction 64 are thereby transmitted to the door leaves 48, 50 of the shaft door 46 (FIGS. 1 and 3). The width direction 64 extends horizontally in the direction of the opening and closing movement of the door leaf. During opening of the car door leaves 44, 45 the shaft door 46 is similarly opened, due to the unlocking of the shaft door lock and due to the coupling between the car door leaf 44 and the shaft door leaf 50, by the coupling parts 52, 54 at the car door side and the coupling means 38 at the shaft door side. In this regard the skid-shaped coupling parts 52, 54 at the car door side act as entrainer device 55.

The marking device 1 serving at least for aligning the coupling means 38 at the shaft door side comprises a mounting unit 22 which mounts the light emission unit 10 to be rotatable about an axis 80 of rotation, which axis extends horizontally in a specific operating state (FIG. 7). A lens prism 28 of the light emission unit 10 so spreads out the light beam of the laser 24 that it is formed into a light beam 76 which propagates in a beam plane so that it marks a straight line on a planar surface arranged at right angles to the main direction of the light beam. The lens prism 28 forms a beam shaping means 142, which is preferably exchangeable. The light emission unit 10 is also so settable—particularly by exchange of the beam shaping means 142—that the light beam 76 generates two intersecting lines or a punctiform marking on a planar surface arranged at right angles to the main direction of the light beam. The marking device 1 comprises a leveling unit 148 which is formed as a spirit level and which is provided for horizontal orientation of the marking device. In order to set specific rotational positions of the light emission unit 10, which are each uniquely characterized by a specific rotational angle with respect to the axis 80 of rotation, the marking device comprises a detent unit (not illustrated) having at least four detent points. Fixing of the light emission unit 10 in rotational positions which preferably arise from rotations about the axis 80 of rotation through 90 degrees from one another is achievable by means of the detent points. In an operating position, which is aligned by means of the leveling unit 148, of the marking device the light emission unit 10 in the defined rotational positions preferably radiates in a horizontal direction or in a vertical direction.

In addition, the marking device comprises fastening means 30, 82, 84 which are constructed as magnets. Alternatively or additionally the marking device can comprise fastening means for fastening, by mechanically positive and/or frictional and/or material coupling, of the marking device to an elevator car device or to an elevator shaft device. A fastening of the marking device can in addition by realized by means of a clamping device or by screws, rivets and/or welding. The elevator car device 56 comprises a fastening unit 36 which is formed by the car door lintel 43 (FIGS. 8 and 9). The fastening unit 36 has a planar surface 86 which has exclusively horizontal area dimensional directions. The fastening means 30, 82 of the marking device lie on the surface 86 and fasten the marking device to the fastening unit 36, which is of metal construction. The fastening means 84 of the marking device additionally bear against a further surface of the fastening unit 36, which has a vertical area dimensional direction (reverse side of 102 not illustrated). The fastening means 30, 82, 84 define a bend (FIG. 7). The bend is provided for positioning the marking device. The marking device has a battery 88 for supply of current to the laser 24. In principle, the marking device can also have a current connection interface.

Moreover, the marking device 1 comprises two adjusting screws 90 by means of which a fine adjustment of a direction of the light beam 76 is performable. Moreover, provided at an upper side of the marking device is a switch 92 for switching on the marking device.

A light emission unit 10 mounted on an elevator car device 56 can in addition be positioned so that during a maintenance or mounting procedure it generates by way of the spread-out, vertically directed light beam 76 a marking by means of which, for example, the door posts 96 (FIG. 1) of the shaft door 46 are alignable parallel to the light beam 76. Moreover, the light emission unit 10 is rotatable through 90 degrees so that the main direction of the light beam corresponds with the horizontal direction. The shaft door lintel 47 and a guide rail 100 of the shaft door 46 can thereby be marked by means of the spread-out light beam and horizontally aligned (FIG. 3). In this setting a shaft door sill 101 can similarly be marked by a horizontally extending light marking, whereby the shaft door sill is alignable horizontally. For this purpose the elevator car 5 and thus the marking device are to be positioned at a height suitable for marking the respective elevator component.

Alternatively, the car door sill 103 of the car door 42 (FIG. 4) and the shaft door sill 101 of the shaft door 46 can be adjusted by means of the marking device in that the light beam 76 is so shaped by a beam shaping means that it propagates in one plane or in two beam planes intersecting at right angles. In that case, the one beam plane 104 of the light beam 76, which is oriented vertically in its main direction, marks a straight line on at least one of the said door sills (FIG. 8). A respective longitudinal edge of each of the two door sills is then to be oriented parallelly to this straight line.

FIG. 10 shows a maintenance situation in which the light beam 76, which is radiated by the light emission unit, propagates in a beam plane 105 extending at right angles to a surface of the front side 154 of the shaft door leaf 50 and in vertical direction. The beam plane 105 has an opening angle (spread angle) 152 which has the effect that the light beam 76 can generate a positioning marking 14 at a planar surface of an elevator component (here the coupling part 15 at the shaft door side), which extends parallel to the (here vertical) main direction of the light beam 76. The positioning marking 14 has in that case the form of a line which extends parallelly to the said main direction (here in vertical direction).

FIG. 11 shows a maintenance situation in which the light beam 76 is so shaped by a beam shaping means that it propagates in two beam planes 104, 105 intersecting at right angles. Marking lines can thus be generated at planar surfaces of elevator components which extend substantially parallelly to the main direction of the light beam 76 and parallelly to one of the beam planes 104, 105. Moreover, as shown in FIG. 11, for example, the end surfaces 106 of the shaft door rollers 18, 20 can thereby be adjusted parallelly to the beam plane 104 of the light beam 76.

As illustrated in FIGS. 12 and 13, the light emission unit 10 of the marking device 1 can, for positioning of elevator components (here the coupling part 15 and the shaft door rollers 18, 20 of the coupling means 38 at the shaft door side), also radiate the light beam 76 upwardly in vertical direction. The marking device 1 with the light emission unit 10 is in that case preferably fixed on the car door lintel 43, which serves as an elevator car device, of the elevator car 5. An upwardly directed light beam is particularly advantageous when the shaft door 46 to be adjusted is that which is assigned with the uppermost part of the elevator shaft and accordingly an adjustment of the said elevator components 15, 18, 20 by the engineer cannot be carried out from the elevator car 5. In this case the engineer stands on the roof of the elevator car 5 in order to carry out the said adjustments, wherein the elevator car 5 is moved into a position in which the car door 42 is displaced downwardly relative to the shaft door 46 to such an extent that the engineer can conveniently position the coupling means 38 at the shaft door side by way of the upwardly directed light beam 76. In this situation use can also be made of a light beam 76 with two beam planes intersecting at right angles (FIG. 13).

In a particularly advantageous form of embodiment of the marking device or of the marking method according to the invention the marking device includes a light emission unit which can radiate a light beam in opposite direction. Thus, it is no longer necessary to pivot the light emission unit through half a turn in order to be able to use the light beam in upward direction and also in downward direction.

FIG. 14 shows the marking device in an operational situation in which the light emission unit 10 radiates the light beam 76, which here forms one beam plane, upwardly in vertical direction.

FIG. 15 shows the marking device in a situation in which the light emission unit 10 similarly radiates the light beam 76, which here forms two beam planes crossing at right angles, upwardly in vertical direction.

In principle, it is also conceivable for the marking device to comprise further light emission units which simultaneously mark target positions of components to be positioned. Such components can be, for example, the shaft door sills, door posts of the shaft door 46 or of the car door 42 and/or guide rails (not illustrated) of the elevator car 5.

Moreover, the marking device can be arranged at other locations of the elevator car 5 in order to characterize and/or align one of the many elevator components present in an elevator shaft. In addition, it is conceivable for a vertical position of the elevator car 5 to be determined with the help of the marking device, for example by means of a laser distance measurement.

Alternative exemplifying embodiments are illustrated in FIGS. 16 to 19. Components, features and functions remaining substantially the same are basically numbered by the same reference numerals. However, in order to distinguish the exemplifying embodiments the letters 'a', 'b', etc., are added to the reference numerals of the exemplifying embodiments in FIGS. 16 to 19. The following description is substantially confined to the differences from the exemplifying embodiment in FIGS. 1 to 15, wherein with respect to components, features and functions remaining the same reference can be made to the description of the exemplifying embodiment in FIGS. 1 to 15.

FIG. 16 shows an alternative exemplifying embodiment of a marking device 1*a*, which comprises three adjusting screws 90*a*. Each of the adjusting screws 90*a* has a respective end region 108*a*, which is arranged, for example, on the surface 86 of the car door lintel 43 (FIG. 9). In the case of at least two of the three adjusting screws 90*a* the end region 108*a* is formed by a magnet. The marking device additionally comprises a mounting unit 22*a* which mounts a mounting means 109*a* of the marking device to be rotatable about an axis 160*a* of rotation, wherein the axis 160*a* of rotation extends horizontally in the illustrated operating state. The mounting 109*a* means is lockable by way of a fixing means 121*a* in a specific rotational position with respect to rotations about the axis 160*a* of rotation. A holding means 111*a* is mounted by the mounting means 109*a* to be rotatable about an axis 117*a* of rotation. The holding means 111*a* accepts a weight force of a light emission unit 10*a* of the marking device and mounts the light emission unit 10*a* to be translationally displaceable between two abutments 113*a*, 115*a*. A mass center point 119*a* is, in an operating position, arranged in vertical direction below the axis 117*a* of rotation and thereby determines a position of the light emission unit 10*a* which is mounted to be freely rotatable about the axis 117*a* of rotation. Alternatively, it is obviously also possible for a blocking device to be present by which the rotation of the holding means 111*a* and thus of the light emission unit 10*a* about the axis 117*a* of rotation can be blocked in a desired setting.

The laser 24*a* is constructed as a laser diode. Moreover, the light emission unit 10*a* comprises a lens 26*a* which is constructed as a cross lens and defines a shape of cruciform light beam 76*a*. The lens 26*a* forms a beam shaping means 142*a*. The marking device 1*a* comprises a leveling unit 148*a*. The leveling unit 148*a* is formed by a box level.

FIG. 17 shows an elevator shaft device, which is constructed as a shaft door lintel 47*b* of a shaft door 46*b*, with a mounting device 123*b* which is provided for carrying and fixing a marking device to be fixedly mounted in the elevator shaft.

The mounting device 123*b* comprises positioning markings 125*b* which form a positioning device 32*b* for positioning the marking device. If the marking device is positioned on the mounting device 123*b* or on the door lintel, then the positioning of elevator components in the elevator shaft and also at the elevator car with respect to the position of the shaft door is possible. In a given case a fine adjustment of the position of the marking device is required beforehand, which can be undertaken by displacement of the marking device along a width dimensional direction 64*b* of the shaft door 46*b*.

FIG. 18 shows an elevator car device 56*c* which belongs to the elevator car 5*c* and which is constructed as part of a car door lintel 43*c*. The elevator car device 56*c* comprises a mounting device 123*c* which is provided as a mount for a marking device. Mounted on the car door lintel 43*c* are positioning markings 125*c* which form a positioning device 32*c* for positioning the marking device. If the marking device is positioned, then a positioning of elevator components with respect to the position of the elevator car 5*c* or the coupling parts 52*c* and 54*c* at the car door side is possible. In particular, a marking device fixed to the elevator car device 56*c* enables marking and orientation of elevator components such as the coupling parts 15*b*, which are at the shaft door side, with the shaft door rollers 18*b*, 20*b* at the shaft door leaves 50*b* (FIG.

17). In a given case, for precise positioning of the elevator components a fine adjustment of the marking device is required, which can be undertaken by a displacement of the marking device along a width dimensional direction 129*c* of the car door 42*c* of the elevator car 5*c*.

FIG. 19 shows, like FIG. 1, a view from the interior space of an elevator car (not illustrated here) onto a car door 42*d* with two partly opened car door leaves 44*d*, 45*d* and a shaft door 46*d*, which is arranged therebehind, with closed shaft door leaves 48*d*, 50*d*, with an alternative exemplifying embodiment of a marking device. Apart from the already known light emission unit 10*d* for positioning of the coupling means 38*d* at the shaft door side, this marking device comprises three further light emission units 10.1*d*, 10.2*d*, 10.3*d* which serve, in particular, the purpose of characterizing elevator components in the region of the shaft door 42*d* and the respective shaft doors 46*d* opposite the car door or pointing to such elevator components so that they are not overlooked or forgotten during a maintenance procedure. The light emission units 10.1*d*, 10.2*d*, 10.3*d* each include a laser (not illustrated) and are fixed on a support 135*d* which is mounted on a car door lintel 43*d* serving as elevator car device 56*d*. The support 135*d* thus forms a fastening unit 36*d* for the light emission units 10.1*d*, 10.2*d*, 10.3*d*, wherein these are preferably easily mountable and demountable in order to be able to be used in different elevator installations. Such a support with the light emission units fixed thereto can obviously also be permanently installed in an elevator installation.

During a maintenance or mounting operation the light emission unit 10.1*d* marks a cable 137*d* which moves a car door leaf 44*d* of the door 42*d* during an opening or closing movement of the elevator doors. The light emission unit 10.1*d* directs the engineer to the cable 137*d* so that the engineer checks the state of the cable. A further light emission unit 10.2*d* marks a compression spring 138*d* which determines the cable tension of the cable 137*d*. The light beam 76 of the light emission unit 10.2*d* marks the compression spring so as to direct the engineer to check the state of the spring and adjust the spring length of the compression spring so as to ensure a specific cable tension.

A third light emission unit 10.3*d* points to an electrical safety contact 139*d*, the function of which is to be checked during a maintenance procedure. The safety contact 139*d* has to conduct the current with a small voltage drop when the associated shaft door leaf 50*d* of the shaft door 46*d* is closed.

Moreover, it is conceivable that at least one of the light emission units 10.1*d*, 10.2*d*, 10.3*d* during at least one operating process produces a positioning marking for positioning at least one elevator component.

In addition, it is conceivable that the light emission units 10.1*d*, 10.2*d*, 10.3*d* carry out characterizing or marking processes in succession, i.e. the individual light emission units are activated in succession by means of a control unit in correspondence with a mounting or maintenance plan.

Marking devices in accordance with the invention with a light emission unit or with several light emission units can be fixedly or temporarily installed at the most diverse places in an elevator installation in order to position elevator components relative to a reference element or in order, during mounting or maintenance procedures, to indicate mounting locations of elevator components or already installed elevator components.

For mounting and maintenance purposes use could be made of marking devices in which a light emission unit is pivotable about at least two axes, wherein the pivot movements can be executed by means of controllable and regulable positioning motors. It is thus possible to quickly and precisely mark a plurality of mounting locations and/or positioning markings sequentially by a light beam in accordance with a mounting or maintenance plan. The work effort can thus be minimized and a low probability of error achieved. A possible development of the invention consists in that the laser present in the light emission unit is constructed as a distance measuring laser in order to thus obtain even further adjustment possibilities for the positioning of components in elevator installations.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A marking device in an elevator installation, comprising: a light emission unit being fixed to an elevator car device, the light emission unit being selectively operable to emit a light beam to produce a temporary marking indicating at least one of a target position for mounting an elevator component in the elevator installation, a reference position for positioning an elevator component mounted in the elevator installation, and an elevator component of the elevator installation for due for maintenance.

2. The marking device according to claim 1 wherein the elevator car device is a car door lintel.

3. The marking device according to claim 1 wherein the elevator component is a coupling means mounted on a shaft door leaf of the elevator installation.

4. The marking device according to claim 1 wherein the light emission unit includes a laser that emits the light beam.

5. The marking device according to claim 1 wherein the light emission unit includes a beam shaping means that spreads out the light beam to propagate in at least one plane.

6. The marking device according to claim 1 including at least one magnetic fastening means for fixing the light emission unit to the elevator car device.

7. The marking device according to claim 1 including at least two of the light emission unit producing spaced apart ones of the temporary marking.

8. A marking method for an elevator installation comprising the steps of:

providing a marking device having a light emission unit being selectively operable to emit at least one light beam;

fixing the marking device to an elevator car device of an elevator car;

operating the light emission unit to emit the a light beam to produce a temporary positioning marking in the elevator installation; and at least one of mounting and positioning an elevator component with reference to the positioning marking from a roof of the elevator car or from the elevator car through an opened car door.

9. The marking method according to claim 8 including marking a target position at which the elevator component is to be positioned during the positioning step.

10. The marking method according to claim 8 including fixing the marking device to a car door lintel of the elevator car.

11. The marking method according to claim 8 including before positioning of the at least one elevator component, moving the elevator car into a position at which a car door lies above or below an adjacent shaft door.

12. The marking method according to claim 8 wherein the elevator component is a coupling means at a shaft door side or a shaft door roller of the coupling means at the shaft door side.

13. A marking device in an elevator installation, comprising: at least one light emission unit being fixed to an elevator car device, which device is formed by a car door lintel of an elevator car, the at least one light emission unit being selectively operable to emit at least one light beam to produce at least one temporary positioning marking on at least one elevator component in the elevator installation.

14. The marking device according to claim 13 wherein the at least one light emission unit includes a laser that emits the at least one light beam.

15. The marking device according to claim 13 wherein the at least one light emission unit includes a beam shaping means that spreads out the at least one light beam to propagate in at least one plane.

16. The marking device according to claim 13 including at least one adjusting screw engaging the elevator car device for selectively adjusting a direction of the at least one light beam.

17. The marking device according to claim 13 including a mounting unit, the at least one light emission unit being rotatably attached to the mounting unit for rotation about an axis of rotation.

18. The marking device according to claim 17 including a fixing means for locking the at least one light emission unit in a selected rotational position.

19. The marking device according to claim 17 including a holding means attached to the mounting unit for rotating the at least one light emission unit about another axis of rotation.

* * * * *